US005358243A

United States Patent [19]

Eddy et al.

[11] Patent Number: 5,358,243

[45] Date of Patent: Oct. 25, 1994

[54] BALL TROUGH FOR PINBALL GAMES

[75] Inventors: Brian Eddy, Addison; Carl Biagi, Warrenville, both of Ill.

[73] Assignee: Williams Electronics Games, Inc., Chicago, Ill.

[21] Appl. No.: 128,361

[22] Filed: Sep. 28, 1993

[51] Int. Cl.[5] ..... A63F 7/34

[52] U.S. Cl. ..... 273/121 D

[58] Field of Search ..... 273/118–125

[56] References Cited

U.S. PATENT DOCUMENTS

| | | | |
|---|---|---|---|
| 2,120,440 | 6/1938 | Kramer et al. | 273/121 A |
| 2,551,023 | 5/1951 | Levitt | 273/121 A |
| 2,584,956 | 2/1952 | Williams | 273/121 E |
| 2,660,435 | 11/1953 | Durant | 273/121 A |
| 3,441,279 | 4/1969 | Lally et al. | 273/121 A |
| 4,548,408 | 10/1985 | Clark | 273/121 D X |
| 5,181,722 | 1/1993 | Krutsch et al. | 273/119 A X |

*Primary Examiner*—Vincent Millin
*Assistant Examiner*—Raleigh W. Chiu
*Attorney, Agent, or Firm*—Rockey, Rifkin and Ryther

[57] ABSTRACT

The ball trough is of a unitary construction such that it is mounted directly to the underside of the playfield as a single piece. The ball trough consists of a generally U-shaped channel that is mounted to the underside of the playfield and extends between the drain hole and the shooter lane. The bottom surface of the channel is inclined relative to the horizontal such that a ball entering at the drain hole will roll under the force of gravity toward the shooter lane. When activated, the solenoid plunger will kick the ball located adjacent the shooter lane up through an aperture in the playfield and into the shooter lane. A series of optical switches are mounted on the channel and arranged such that each switch will detect the presence or absence of the ball in the queue.

9 Claims, 5 Drawing Sheets

BALL TROUGH FOR PINBALL GAMES

BACKGROUND OF THE INVENTION

The invention relates, generally, to pinball games and, more particularly, to an improved ball trough for such games.

Pinball games typically consist of an inclined playfield supporting a plurality of play features such as targets, ramps, bumpers and the like. Player controlled flippers are pivotably mounted on the playfield near the bottom thereof. The player manipulates the flippers to direct the ball at selected play features thereby to control play of the game and score points.

To begin play of the game typically the player manipulates a spring loaded plunger that propels the ball up a shooter lane and onto the playfield. Play continues until the ball drains from the playfield via a drain hole. In the typical pinball game the drain hole is located behind the flippers such that if the player misplays the ball it will roll between the flippers into the drain hole and exit the playfield to terminate play of that ball. As will be appreciated, the player is usually provided with three, four or even five balls per game. Thus, when one ball drains from the playfield another ball will be loaded into the shooter lane.

Located in the playfield, out of sight of the player, is a ball trough. The ball trough extends from the drain hole to the shooter lane and is the mechanism by which the balls are retrieved from the drain hole and delivered to the shooter lane.

The prior art ball trough is a multicomponent assembly that must be assembled on the playfield during the manufacture of the game. Referring to FIGS. 1–3, the assembly consists of a cutout 1 in the playfield 3 in which base member 5 is fixed. Base member 5 includes a central aperture 7 that defines a pair of rails 9*a* and 9*b* on which the ball rides. Base member 5 is formed as a ramp with a peak in the middle thereof (best shown in FIG. 3) such that a ball does not freely roll from the inlet end 11 to the outlet end 13.

A substantially v-shaped rail 15 is secured to the top of playfield 3 and forms one side rail of the ball trough and Straight rail 17, also secured to the top of playfield 3, forms the opposite side rail for the ball trough.

Located at inlet end 11 is a first mechanical (leaf) switch 19 that provides a signal to the game microprocessor indicating that a ball has entered the ball trough. Four additional mechanical switches 21, 23, 25 and 27 are provided between switch 19 and outlet end 13 and are arranged such that each switch will detect the presence or absence of balls queued on base member 5.

Mounted to the playfield adjacent the inlet end 11 is a solenoid kicker mechanism 25 consisting of a kicker arm 27 pivotably mounted on the playfield at pin 29. A solenoid 31 has its plunger 33 connected to kicker arm 27 such that activation of the solenoid causes the kicker arm to pivot through an aperture in rail 15 to kick the ball located at inlet end 11 over the peak formed in base member 5 to the ball queue. Spring 37 returns kicker arm to the original position.

Referring to FIG. 3, a second kicker mechanism 39 is mounted to the underside of the playfield adjacent outlet end 13. Kicker mechanism 39 consists of a kicker arm 41 pivotably mounted to support 43 that is fixed to the underside of the playfield. Solenoid 45 has its plunger 47 connected to arm 41 such that the activation of solenoid 45 causes kicker arm 41 to extend through the cutout 1 and kick the ball located at the outlet end 13 onto the playfield. An inclined diverter plate 49 is fixed to rail 17 to guide the kicked ball onto the playfield.

The game microprocessor controls the two kickers based on signals from switches 21, 23, 25 and 27 which track the movement of the balls in the ball trough from the drain hole to the shooter lane adjacent the plunger. As is evident from the foregoing description, the prior art trough is made of multiple components that must be assembled to the playfield during game manufacture. The use of the multiple components, especially the two solenoids, is an expensive design that is difficult and time consuming to assemble and maintain.

Thus, a simpler, more cost effective, preassembled ball trough for pinball games is desired.

SUMMARY OF THE INVENTION

The ball trough of the invention is of a unitary construction such that it is mounted directly to the underside of the playfield as a single piece. The ball trough consists of a generally U-shaped channel that is mounted to the underside of the playfield and extends between the drain hole and the shooter lane. The bottom surface of the channel is angled relative to the horizontal such that a ball entering at the drain hole will roll by the force of gravity toward the shooter lane. A single solenoid is mounted below the channel adjacent the shooter lane. When activated, the solenoid plunger will kick the ball located closest to the shooter lane (assuming more than one ball is in the trough) through an aperture in the playfield and into the shooter lane. A series of optical switches are mounted on the channel and arranged such that each switch will detect the presence or absence of a ball in the trough at a particular location thereby to identify how many balls are present.

DETAILED DESCRIPTION OF THE INVENTION

Figure 1:
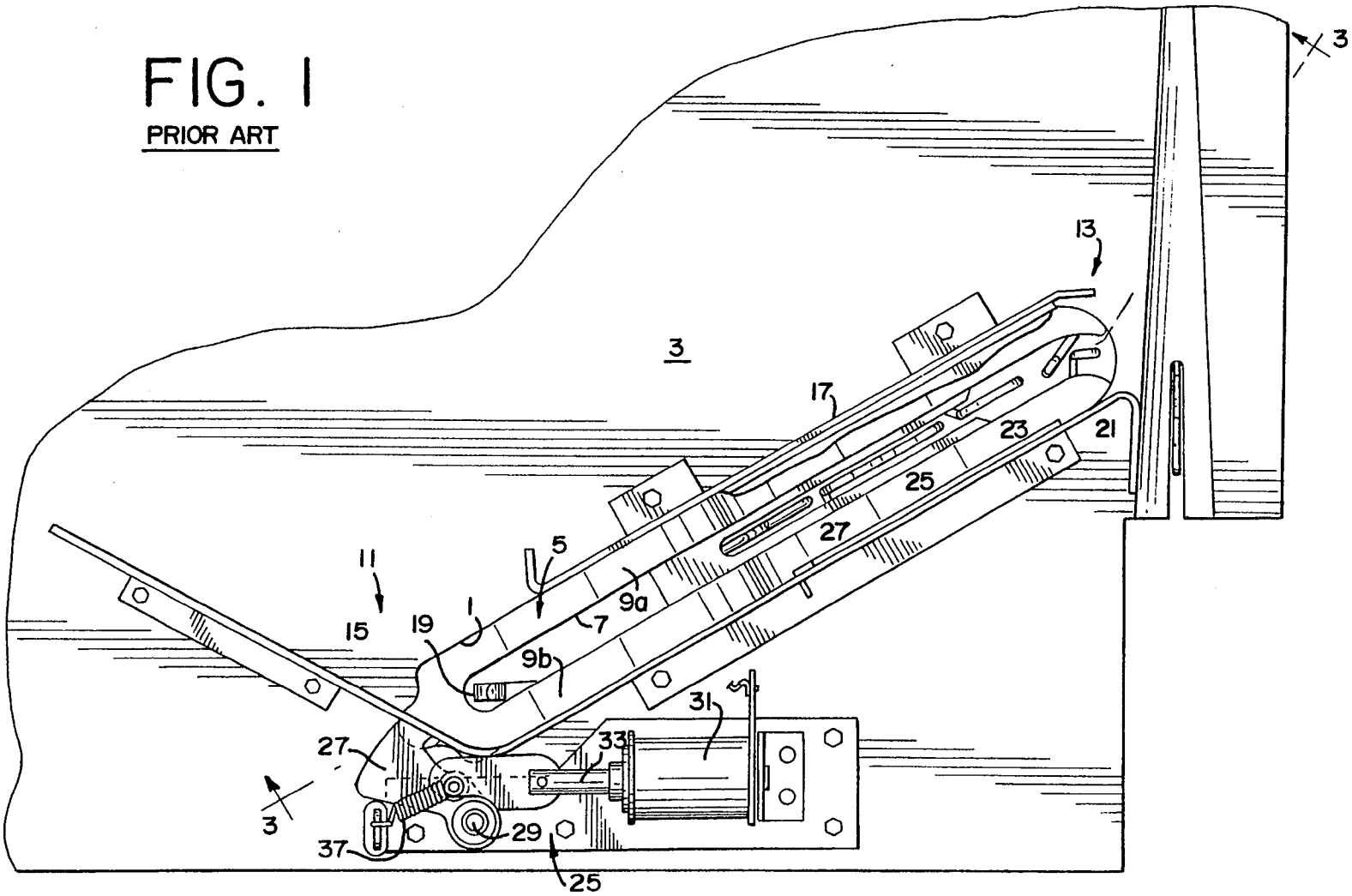
FIG. 1 PRIOR ART
FIG. 1 is a top view of the prior art ball trough.
Figure 2:
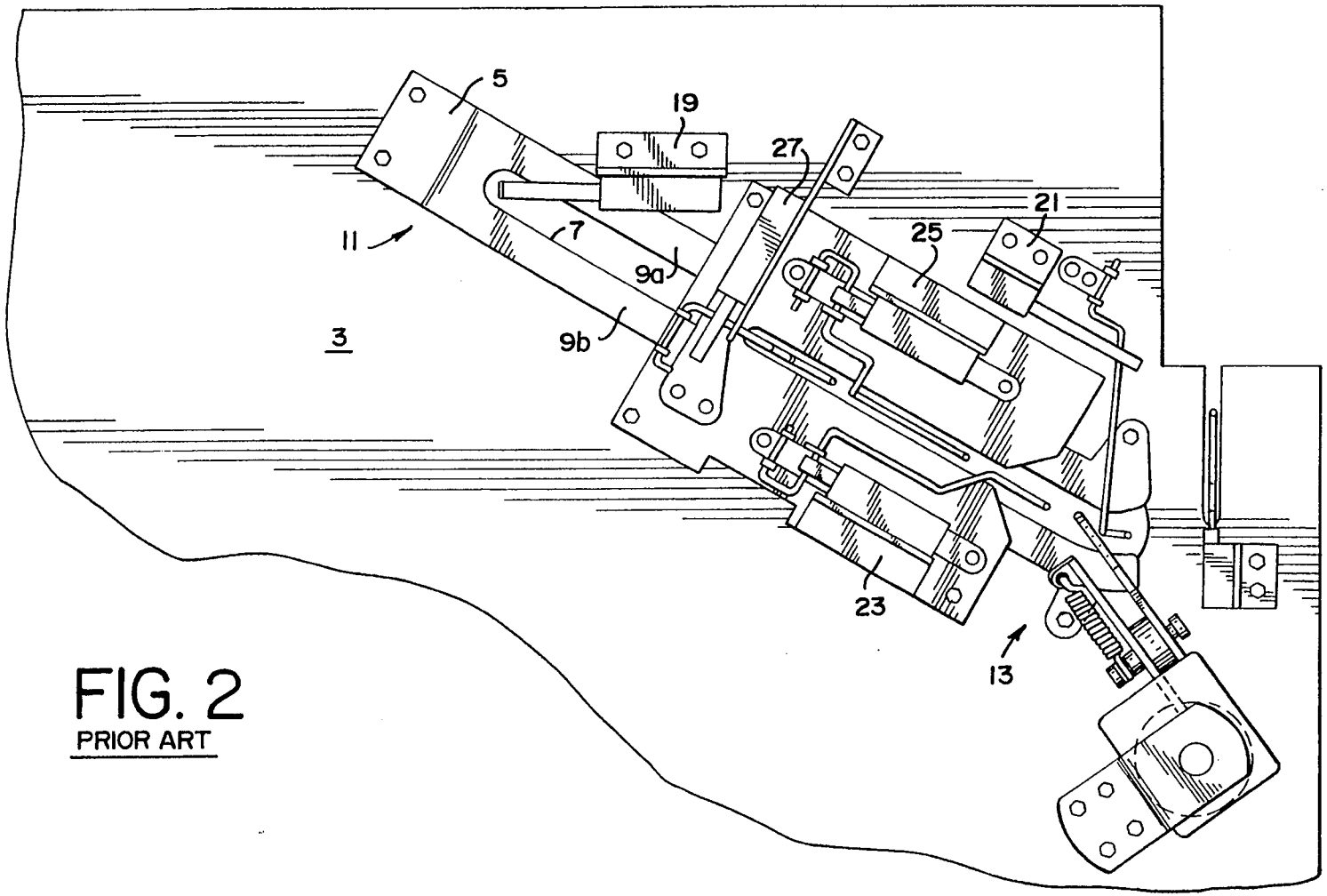
FIG. 2 PRIOR ART
FIG. 2 is a bottom view of the prior art ball trough.
Figure 3:
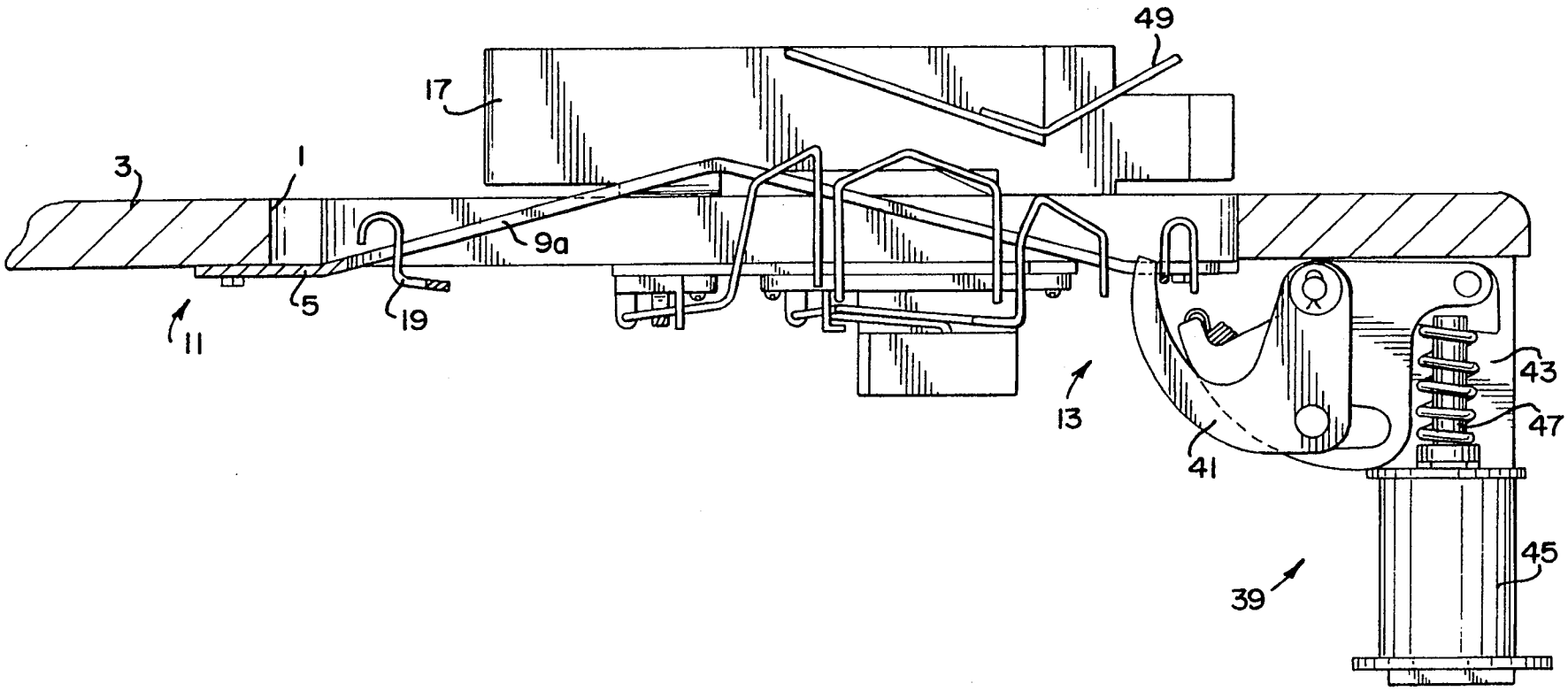
FIG. 3 PRIOR ART
FIG. 3 is a view along line 3—3 of FIG. 1 of the prior art ball trough.
Figure 4:
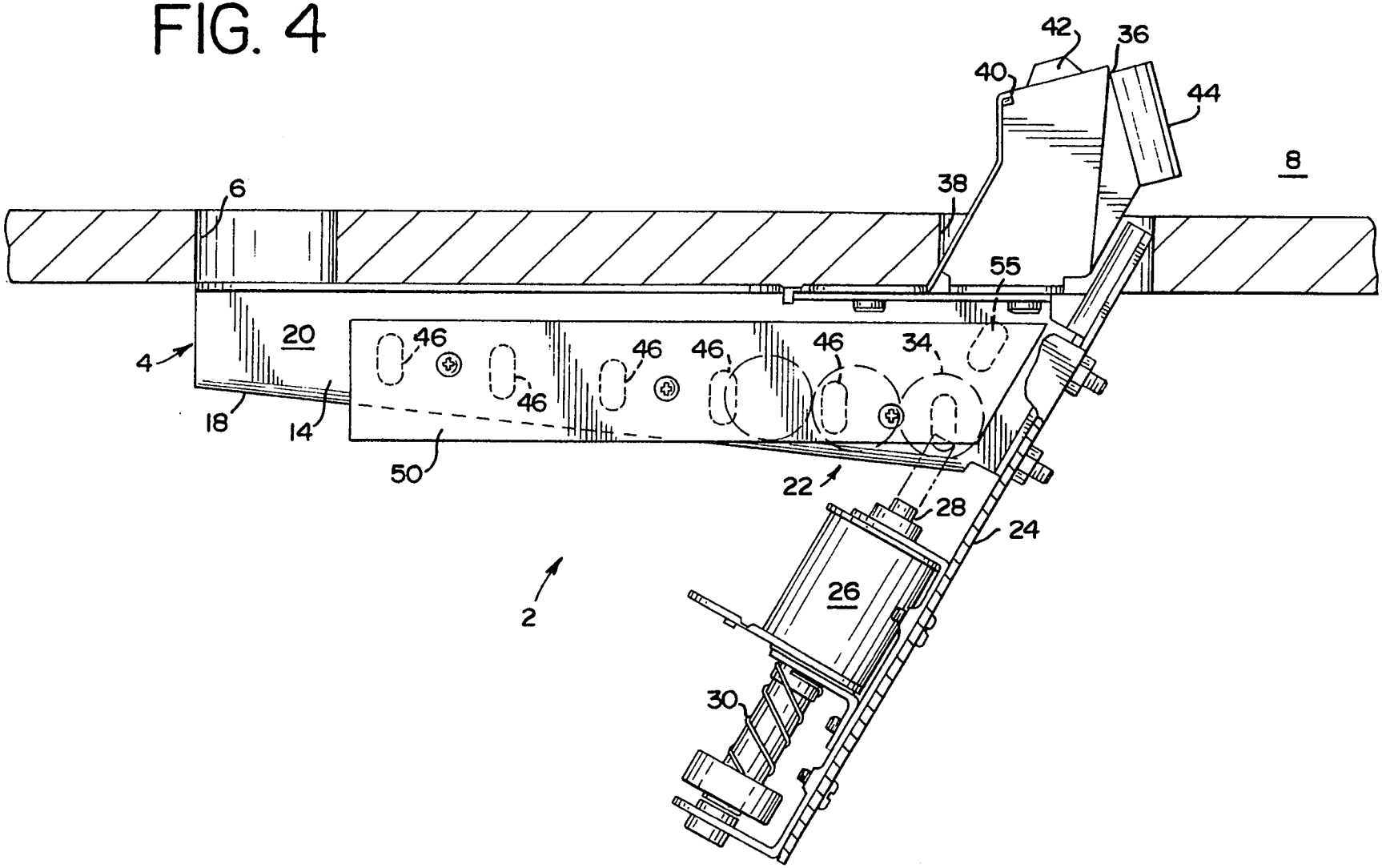
FIG. 4 is a side view of the ball trough of the invention.
Figure 6:
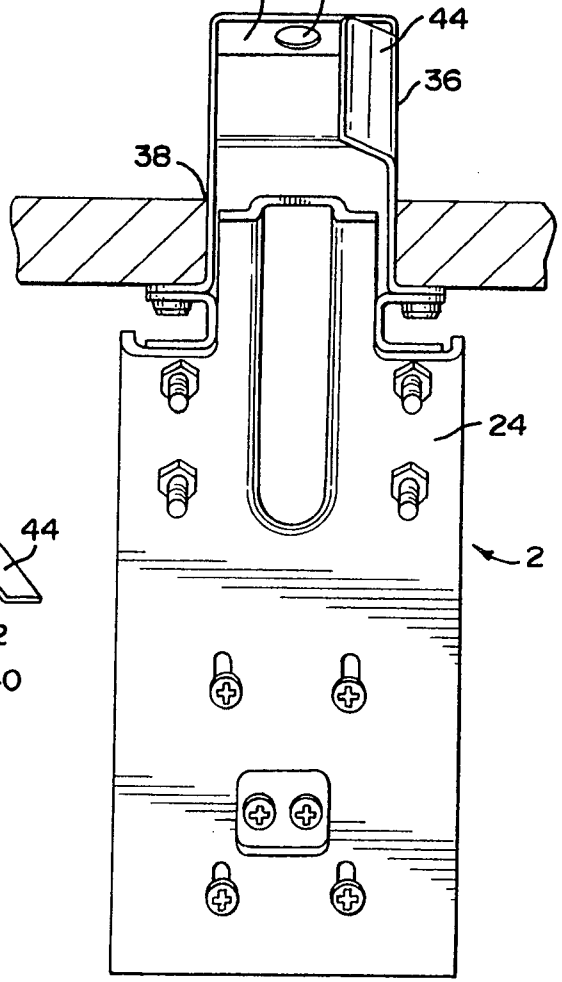
FIG. 6 is an end view of the ball trough of the invention.
Figure 5:
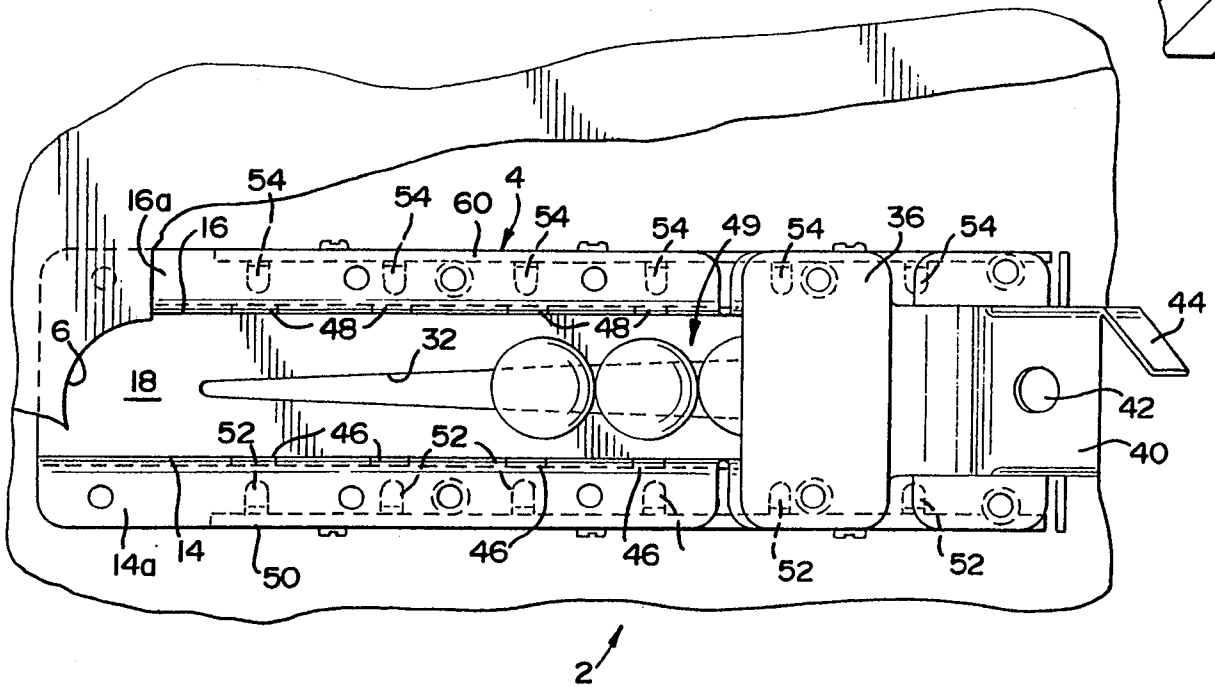
FIG. 5 is a top view of the ball trough of the invention.

The ball trough of the invention (FIGS. 4–6) is shown generally at 2 and is a complete, unitary assembly that can quickly and easily be mounted to the underside of a playfield. Specifically, trough 2 consists of an elongated, substantially U-shaped channel 4 that extends for substantially the distance between drain hole 6 and shooter lane 8. The sides 14 and 16 of channel 4 extend perpendicularly from playfield 10 and are formed integrally with and support bottom 18. Laterally extending flanges 14*a* and 16*a* extend from sides 14 and 16, respectively, and are fixed to the underside of playfield 10 by suitable fasteners. As best shown in FIG. 4, the bottom 18 is inclined relative to horizontal such that a ball dropping onto inlet end 20 from drain hole 6 will roll by force of gravity toward outlet end 22. As best shown in FIG. 5, a V-shaped groove 32 is formed in bottom 18. Groove 32 centers the balls in channel 4 and allows the solenoid plunger to contact the first ball 34 as will hereinafter be described.

A support plate 24 is fixed to the channel 4 adjacent outlet end 22. Plate 24 is disposed at an acute angle relative to the vertical and supports a solenoid 26 thereon such that its plunger 28 extends parallel to plate 24. When solenoid 24 is activated, plunger 28 will extend through V-shaped groove 32 into the channel 4 as shown in dashed line in FIG. 4. Plunger 28 will strike the first ball 34 in the trough to kick it out of channel 4. A compression spring 30 returns the plunger 28 to the illustrated solid line retracted position upon deactivation of solenoid 26.

Located immediately above ball 34 is a ball guide 36 that extends though aperture 38 formed in playfield 10. Ball guide 36 extends at substantially the same angle as plate 24 such that a ball struck by plunger 28 will travel through ball guide 36 to a position above playfield 10.

A bumper 40 having a resilient plug 42 mounted therein is disposed over the top of guide 36. Bumper 40 is angled such that a ball striking plug 42 will be deflected substantially horizontally into shooter lane 8. A flange 44 is formed at the exit of guide 36 and is angled slightly rearwardly. The ball, after being deflected off of plug 42 will be guided by flange 44 toward the plunger typically located in the front shooter lane 8.

Disposed in each of sides 14 and 16 of channel 4 are six spaced apertures 46 and 48, respectively, arranged such that apertures 46 are aligned with apertures 48. A circuit board 50 is mounted on side 14 and supports six light emitters 52, each light emitter being aligned with one of holes 46. Likewise, side 16 supports a circuit board 60 carrying six light receptors 54 each of which is aligned with one of holes 48.

As will be appreciated each light receptor and emitter pair form an optical switch. The optical switches are spaced along channel 4 such that each switch detects the presence or absence of a ball in the ball queue 49. The signals from the optical switches are received by the game microprocessor to control the activation of solenoid 26 and the delivery of the balls to the shooter lane 8. They also permit a determination of whether one or more balls are lost or trapped on the playfield.

A further optical switch 53 consisting of a light emitter located in aperture 55 on side 14 (FIG. 4) and a light receptor located in the corresponding aperture (not shown) in the opposite side 16 are arranged in the same manner as emitters 52 and receptors 54 previously described. Switch 53 is positioned above the switch located in apertures 46 and 48 that detects the ball located directly over solenoid 26. Switch 53 is provided to detect the presence of a ball stacked on the ball arranged over solenoid 26. The "stacked" ball arrangement will typically occur when the first ball 34 is not properly ejected from the trough and falls back into ball guide 36 and sits on top of the ball that rolled into the first ball's position. When switch 53 detects the presence of a stacked ball, the microprocessor automatically reenergizes solenoid 26 causing the stacked ball to be ejected.

In operation the ball trough of the invention will begin play of the game with at least as many balls required to complete the player's turn. When the player initiates game play, for example by pushing the start button, the first ball 34 located in channel 4 will be ejected into the shooter lane 8 by solenoid 26. It will be appreciated that when ball 34 is ejected from channel 4, the remaining balls will roll, by force of gravity, to the outlet end 22 of channel 4 such that the second ball in the channel at game start is now located over solenoid 26. The game player will continue play of the game with the first ball until the ball exits the playfield via drain hole 6 and enters channel 4. The ball entering channel 4 rolls by force of gravity to its position as the last ball in the ball queue. This process is repeated until all of the balls available for the player's turn have been played.

To control the operation, the optical switches detect the presence and absence of the balls in the queue and provide signals to the game microprocessor indicative of ball status. The game microprocessor uses the information provided by the switches to determine the number of balls played, the absence of lost or stuck balls, the presence of extra balls and the like as determined by the game program.

While the invention has been described in some detail with reference to the figures, it will be appreciated that numerous changes in the details and construction of the device can be made without departing from the spirit and scope of the invention.

What is claimed is:

1. A pinball game having an inclined playfield supporting a rolling ball, a plurality of play features, a shooter lane for putting a ball in play and a drain hole allowing the ball to exit the playfield, comprising:

a ball trough comprising:

a) a channel fixed to the playfield and having a first end adjacent the drain hole and a second end adjacent the shooter lane, said channel having a surface for supporting a row of balls thereon and positioned to cause the balls to roll from the first end to the second end by force of gravity;

b) kicker means mounted proximate to said second end for kicking one of the balls out of the channel onto the playfield;

c) means for guiding the kicked ball from the channel to the shooter lane; and d) means for detecting the presence or absence of said balls in said channel comprising a plurality of switches arranged along the length of the channel, each one of said plurality of switches positioned to sense one of said balls in the row.

2. The pinball game of claim 1, wherein the surface of ball trough includes means for centering the ball in said channel.

3. The pinball game of claim 2, wherein said means for centering includes a groove formed along the length of the channel.

4. The pinball game of claim 1, wherein said channel is fixed to the underside of the playfield.

5. The pinball game of claim 1, wherein said kicker means includes a solenoid having a reciprocating plunger, the solenoid mounted to the channel such that the plunger can extend through an aperture formed in the channel to contact a ball located at said second end.

6. The pinball game of claim 1, wherein said means for guiding extends through said playfield.

7. The pinball game of claim 1, wherein the kicker means is a solenoid mounted below said channel, said solenoid including a plunger which is projected outwardly to strike the ball when the solenoid is activated thereby to propel said ball from said channel, said plunger positioned in line with the initial path of the ball after being struck by the plunger.

8. The pinball game of claim 1, further including means for detecting the misfiring of the kicker means and for automatically refiring the kicker means to eject a ball.

9. The pinball game of claim 8 wherein the means for detecting the misfiring comprises of a ball sensor for detecting the presence of a ball on top of the first ball in the row.

* * * * *